US008870037B2

(12) United States Patent
Takanohashi

(10) Patent No.: US 8,870,037 B2
(45) Date of Patent: Oct. 28, 2014

(54) PLUG STRUCTURE

(75) Inventor: Toshiyuki Takanohashi, Gyoda (JP)

(73) Assignee: Surpass Industry Co., Ltd., Gyoda-Shi, Saitama (JP)

( * ) Notice: Subject to any disclaimer, the term of this patent is extended or adjusted under 35 U.S.C. 154(b) by 495 days.

(21) Appl. No.: 12/665,407

(22) PCT Filed: Jun. 18, 2008

(86) PCT No.: PCT/JP2008/061116

§ 371 (c)(1),
(2), (4) Date: Dec. 18, 2009

(87) PCT Pub. No.: WO2009/001726

PCT Pub. Date: Dec. 31, 2008

(65) Prior Publication Data

US 2010/0193517 A1 Aug. 5, 2010

(30) Foreign Application Priority Data

Jun. 25, 2007 (JP) ..... 2007-166361

(51) Int. Cl.
*B67D 1/00* (2006.01)
*B67D 7/02* (2010.01)

(52) U.S. Cl.
CPC ..... *B67D 7/0266* (2013.01); *B67D 7/0294* (2013.01)
USPC ..... 222/400.7; 137/212

(58) Field of Classification Search
CPC ..... B67D 1/0832
USPC ..... 222/400.7, 562, 563, 400.8; 137/212
See application file for complete search history.

(56) References Cited

U.S. PATENT DOCUMENTS 706,423 A * 8/1902 Kleinfeldt ..... 222/399
2,969,161 A 1/1961 McCulloch (Continued)

FOREIGN PATENT DOCUMENTS

DE 4216478 A1 12/1983
JP 58-36251 3/1983

(Continued)

OTHER PUBLICATIONS

International Search Report for International Application No. PCT/JP2008/061116, mailed Jul. 15, 2008.

(Continued)

*Primary Examiner* — Paul R Durand
*Assistant Examiner* — Charles P Cheyney
(74) *Attorney, Agent, or Firm* — Thomas, Karceski & Karmilovich, PC

(57) ABSTRACT

A plug structure which allows attachment to a container whose cap attachment screw at the container inlet port is an outer screw is provided. There is provided a plug structure used for a container whose cap attachment screw of a container inlet port is an outer screw, configured to be attached to the container inlet port, and provided with a siphon tube for taking out liquid in the interior of the container including a plug body to be press-fitted into the container inlet port being resiliently deformable in a radial direction at a lower portion thereof, and a locking claw provided on an outer peripheral surface of the lower portion of the plug body so as to project toward an inner wall surface of the container inlet port.

6 Claims, 8 Drawing Sheets

(56) References Cited

U.S. PATENT DOCUMENTS

| | | | | | |
|---|---|---|---|---|---|
| 3,596,810 | A | * | 8/1971 | Taubenheim | 222/400.7 |
| 3,604,602 | A | * | 9/1971 | Lee | 222/400.7 |
| 4,082,206 | A | * | 4/1978 | Patzke et al. | 222/400.7 |
| 4,134,522 | A | * | 1/1979 | Patzke et al. | 222/153.14 |
| 4,436,227 | A | * | 3/1984 | Johnson et al. | 222/382 |
| 4,809,884 | A | * | 3/1989 | Stackhouse | 222/153.04 |
| 4,850,388 | A | * | 7/1989 | Shepherd | 137/212 |
| 4,917,270 | A | * | 4/1990 | Simon | 222/111 |
| 5,012,970 | A | * | 5/1991 | Kucherer | 229/4.5 |
| 5,094,365 | A | * | 3/1992 | Dorfman | 222/400.7 |
| 5,667,253 | A | * | 9/1997 | Jansen et al. | 285/26 |
| 5,765,747 | A | * | 6/1998 | Lawson | 229/125.15 |
| 5,931,350 | A | * | 8/1999 | Heilman | 222/153.14 |
| 6,045,012 | A | * | 4/2000 | Hansen | 222/464.1 |
| 6,068,150 | A | * | 5/2000 | Mitchell et al. | 215/247 |
| 6,079,597 | A | * | 6/2000 | Rauworth et al. | 222/400.7 |
| 6,371,443 | B1 | | 4/2002 | Imai | |
| 6,425,502 | B1 | | 7/2002 | Rauworth et al. | |
| 6,942,127 | B2 | * | 9/2005 | Raats | 222/400.7 |
| 2002/0020449 | A1 | | 2/2002 | Imai | |
| 2006/0225812 | A1 | * | 10/2006 | Hennen et al. | 141/367 |
| 2009/0184133 | A1 | * | 7/2009 | Hasegawa et al. | 222/95 |

FOREIGN PATENT DOCUMENTS

| | | |
|---|---|---|
| JP | 6-51200 | 7/1994 |
| JP | 11-292196 | 10/1999 |
| JP | 2000-230686 | 8/2000 |
| JP | 2002-031288 | 1/2002 |
| JP | 2002-59993 | 2/2002 |
| JP | 2002-114242 | 4/2002 |

OTHER PUBLICATIONS

European Search Report mailed Dec. 8, 2011, in corresponding European Patent Application No. EP 08790554.3.

Japanese Office Action dated Jan. 7, 2014, for Japanese Patent Application No. 2009-520506.

* cited by examiner

PLUG STRUCTURE

CROSS-REFERENCE TO RELATED APPLICATION(S)

This United States Non-Provisional Patent Application is a National Stage Patent Application that relies for priority on PCT Patent Application No. PCT/JP2008/061116, filed on Jun. 18, 2008, and on Japanese Patent Application No. JP 2007-166361, filed on Jun. 25, 2007, the contents of both of which are incorporated herein by reference.

FIELD OF THE INVENTION

The present invention relates to a plug structure to be attached to an opening of a container in which liquid such as highly-refined chemical agents for semiconductors or general chemical agents, for example, is stored.

BACKGROUND OF THE INVENTION

In general, liquid such as the highly-refined chemicals for semiconductors or the general chemical agents is filled in a container such as a glass bottle or a polyethylene tank in a production plant, and is shipped in a state in which a lid is attached to an opening formed on this container for filling and taking out. As a method of taking out liquid stored in such a container, a siphon tube system which introduces gas such as air into the interior of the container and delivers the liquid out of the container by the pressure of the gas is known.

In this system, the lid attached to the opening for filling and taking-out (hereinafter, referred to as "container inlet port") is removed, and then a plug having a siphon tube and a gas supply channel which serves as a liquid flow channel is attached to the opening of the container inlet port. Then, a socket to which a tube for taking out the liquid and a tube for introducing the gas can be connected independently is fitted into the plug, so that a primary flow channel for taking out the liquid and a secondary flow channel for introducing the gas are formed in the plug and socket attached to the opening of the container inlet port (for example, see Japanese Unexamined Patent Application, Publication No. 2002-59993).

SUMMARY OF THE INVENTION

The related art disclosed in Japanese Unexamined Patent Application No. 2002-59993 described above is a connecting tool including a plug to be attached to an opening of a container in which liquid is stored and a socket to be connected to the plug. Since the plug in this case is to be attached to the opening of a container inlet port by being engaged with an inner screw formed therein, it cannot be used for a container formed with an outer screw on the opening of the container inlet port, that is, a container whose cap attachment screw for closing the opening of the container inlet port is the outer screw.

From such a background, in the plug structure used for the container for filling the liquid such as chemical solution and provided with a siphon tube for delivering the liquid out of the container by the pressure of gas, development of the plug structure which allows attachment to a container whose cap attachment screw at the container inlet port is the outer screw is desired.

In view of such circumstances, it is an object of the present invention to provide a plug structure which allows attachment to a container whose cap attachment screw at the container inlet port is an outer screw.

The present invention employs solutions described below for solving the above-described problem.

A first aspect of a plug structure according to the present invention is a plug structure used for a container whose cap attachment screw of a container inlet port is an outer screw, configured to be attached to the container inlet port, and provided with a siphon tube for taking out liquid in the interior of the container, including: a plug body to be press-fitted into the container inlet port being resiliently deformable in a radial direction at a lower portion thereof; and a locking claw provided on an outer peripheral surface of the lower portion of the plug body so as to project toward an inner wall surface of the container inlet port.

According to the plug structure as described above, the lower portion of the plug body to be press-fitted into the container inlet port is resiliently deformable in the radial direction, and the plug body is provided with the locking claw on the outer peripheral surface of the lower portion thereof so as to project toward the inner wall surface of the container inlet port, so that the plug body press-fitted into the container inlet port passes therethrough to a predetermined position by the resilient deformation of the lower portion provided with the locking claw radially inwardly (toward the axial center) by an amount projecting therefrom. Consequently, the locking claw on the lower portion of the resiliently deformed plug body is pressed against the inner wall surface of the container inlet portion by a force in the direction of restoration of its original shape.

A second aspect of a plug structure according to the present invention is a plug structure used for a container whose cap attachment screw of a container inlet port is an outer screw, configured to be attached to the container inlet port, and provided with a siphon tube for taking out liquid in the interior of the container, including a plug body to be press-fitted into the container inlet port being resiliently deformable in a radial direction at a lower portion thereof, a locking claw provided on an outer peripheral surface of the lower portion of the plug body so as to project toward an inner wall surface of the container inlet port, and a flange portion formed to extend outward from an upper end portion of the plug body and locked by an upper end surface of the container inlet port, the flange portion being formed with a seal portion extending over an entire circumference on a lower surface which comes into tight contact with the upper end surface of the container inlet port.

The seal portion in this case includes a projection formed on the lower surface of the flange portion, a packing structure, and a combination of the projection and the packing structure.

According to the plug structure as described above, the lower portion of the plug body to be press-fitted into the container inlet port is resiliently deformable in the radial direction, and the plug body is provided with the locking claw on the outer peripheral surface of the lower portion thereof so as to project toward the inner wall surface of the container inlet port, so that the locking claw of the resiliently deformed lower portion of the plug body is pressed against the inner wall surface of the container inlet port by a force in the direction of restoration to its original shape. Then, since the flange portion formed to extend outward from the upper end portion of the plug body and locked on the upper end surface of the container inlet port is provided, and the flange portion is formed with the seal portion extending over the entire circumference on the lower surface thereof which comes into tight contact with the upper end surface of the container inlet port, the seal portion seals a portion between the outer peripheral surface of the plug and the inner peripheral surface of the container inlet port.

In the second aspect of the plug structure described above, the flange portion preferably includes the seal portion formed over the entire circumference of the upper surface, whereby when attaching the cap, the seal portion on the upper surface of the flange portion functions to improve the sealing property. The seal portion includes the projection formed on the upper surface of the flange portion or a shouldered surface, a packing structure, and the combination of the projection and the packing structure.

In this case, the plug body is preferably configured in such a manner that the ring-shaped lower portion having the locking claw is press-fitted into the upper body and engaged integrally therewith, whereby the projection such as the locking claw can be formed easily by die-cutting.

A third aspect of a plug structure according to the present invention is a plug structure including a gas supply channel attached to a container inlet port for supplying gas into the interior of a container and a siphon tube for taking out liquid in the interior of the container, in which an upper inlet portion of the gas supply channel is formed with an inclined surface which is lowered toward an opening.

According to the plug structure as described above, since the upper inlet portion of the gas supply channel is formed with the inclined surface which is lowered toward the opening, the liquid in the vicinity of the upper inlet port of the gas supply channel flows rapidly downward without staying there.

According to the present invention as described above, the plug structure used for the container for filling liquid such as the chemical solution and provided with the siphon tube for delivering the liquid out of the container allows attachment to the container whose cap attachment screw at the container inlet port is the outer screw.

In addition, it can be press-fitted and fixed reliably to the container inlet port, and the sealing with respect to the container inlet port as well as with respect to the cap is ensured. Also, since the inclined surface which is lowered toward the opening is formed at the upper inlet portion of the gas supply channel, the liquid flows downward easily into the container, so that the accumulation of the liquid and coagulation of the chemical solution are prevented.

DETAILED DESCRIPTION OF EMBODIMENT(S) OF THE INVENTION

Figure 1:
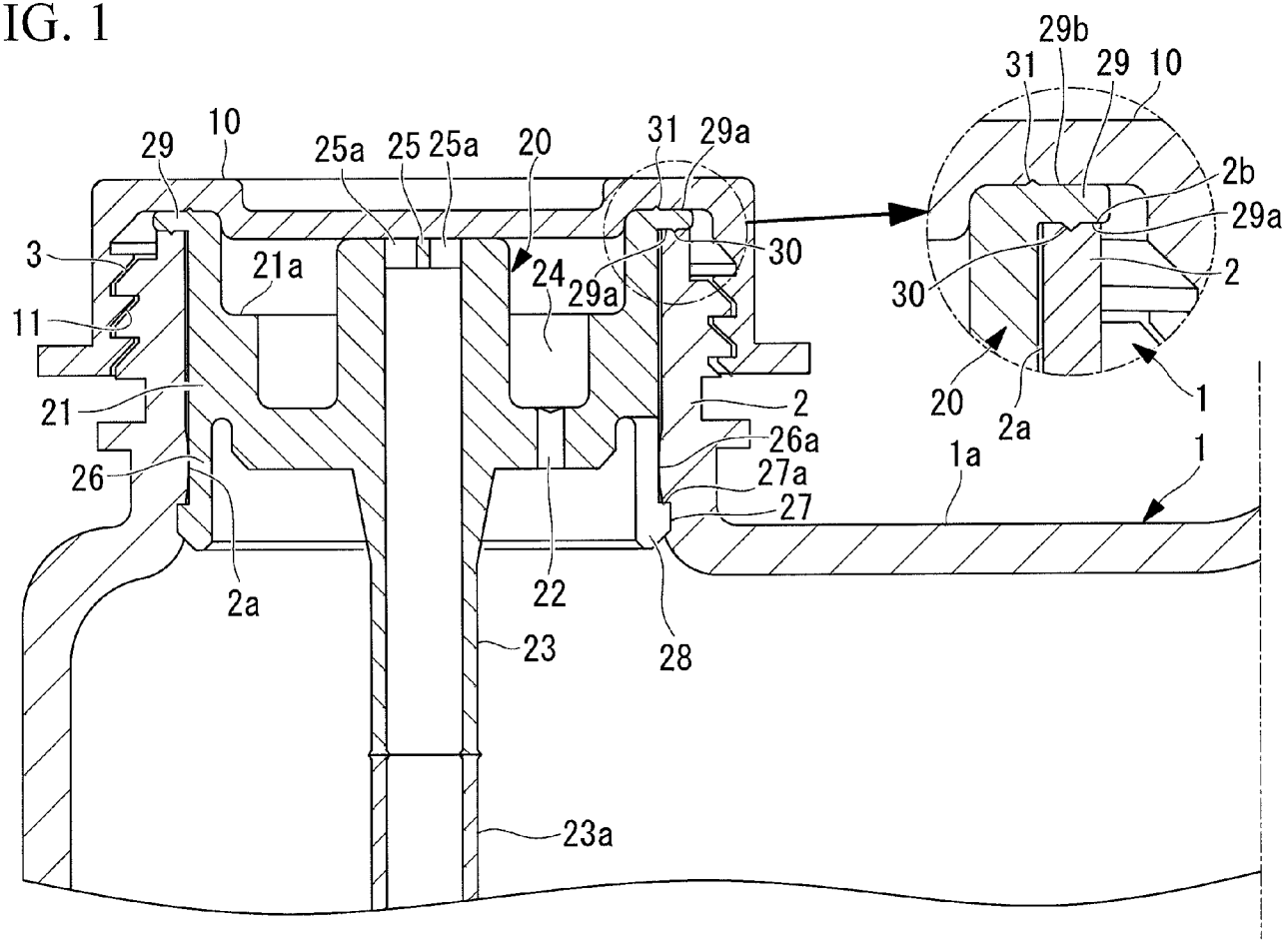
FIG. 1 is a cross-sectional view showing a first embodiment of a plug structure according to the present invention in a state of being attached to a container and closed with a cap.

Referring now to the drawings, an embodiment of a plug structure according to the present invention will be described.

A first embodiment of the plug structure according to the present invention shown in FIG. 1 to FIG. 5 will be described.

Figure 2:
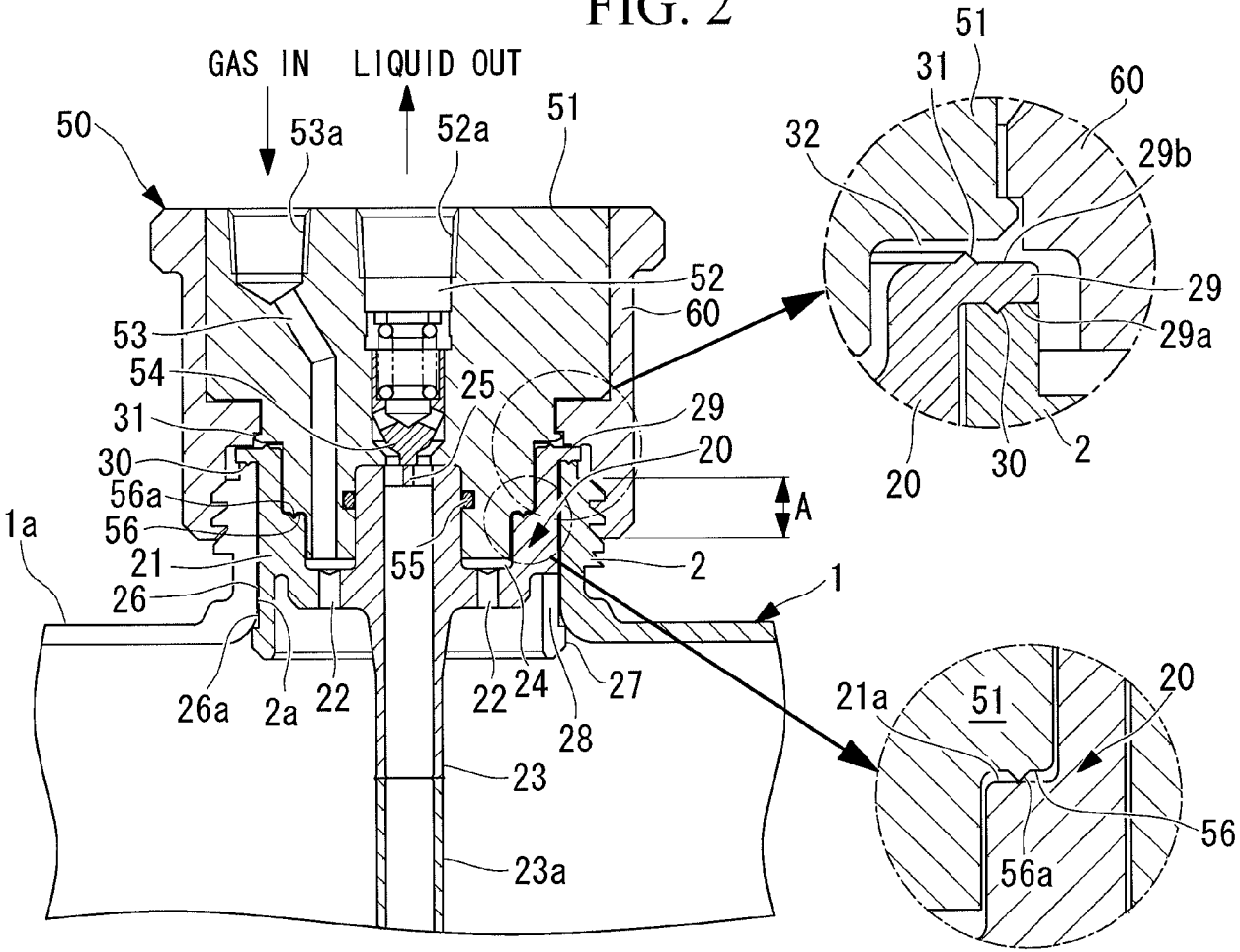
FIG. 2 is a cross-sectional view of the plug structure in FIG. 1 showing an assembled state in which a socket is attached instead of the cap.

In FIG. 1 and FIG. 2, reference numeral 1 in the drawing designates a container, reference numeral 10 designates a cap, reference numeral 20 designates a plug, and reference numeral 50 designates a socket. In order to take out liquid stored in the interior of the container 1, the plug 20 in the present invention is configured to be used in a siphon tube system which introduces gas such as air or the like into the interior of the container 1 and delivers the liquid out of the container 1 by the gas pressure.

The container 1 for filling chemical solution (liquid) such as a highly-refined chemical agent for semiconductor is a mold good formed of, for example, resin being resistant to chemical attack. Provided on an upper portion of the container 1 is a container inlet port 2 for filling and taking out the liquid. The container inlet port 2 is an opening used for filling the liquid such as the chemical solution in the interior of the container 1, or for taking out the chemical solution in the interior of the container 1.

The container inlet port 2 is a cylindrical nozzle projecting upward from a body la of the container 1 and opening at an upper end and, for example, as shown in FIG. 1, the opening of the container 1 can be hermetically closed by attaching the cap 10. The cap 10 in this case is of a type formed with an inner screw 11 on an inner peripheral surface, and is adapted to be attached by being engaged with an outer screw 3 formed on an outer peripheral surface of the container inlet port 2.

Figure 3:
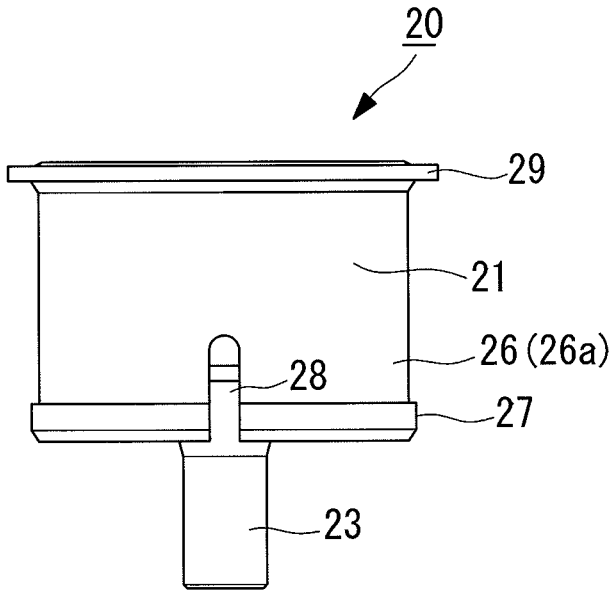
FIG. 3 is an appearance front view of the plug structure shown in FIG. 1.
Figure 4:
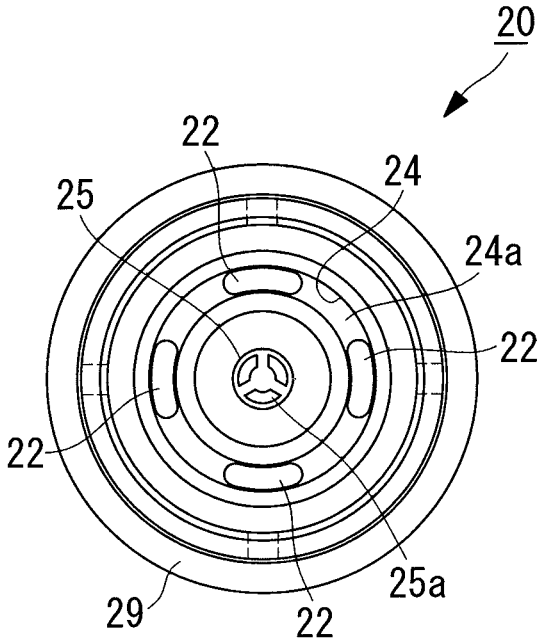
FIG. 4 is a plan view of FIG. 3.

The plug 20 is a mold good formed of resin or the like and is attached to the opening of the container inlet port 2 by press-fitting thereto from above. The plug 20 includes gas flow channels (gas_supply channels) 22 and a siphon tube 23 formed on a substantially cylindrical plug body 21, for example, as shown in FIG. 3 and FIG. 4.

The flow supply channels 22 are flow channels for supplying gas introduced from the outside into the container 1. The gas flow channels 22 are a plurality of holes penetrated through the plug body 21 in the axial direction so as to surround the siphon tube 23 arranged at an axially center of the plug body 21. In the illustrated example, as shown in FIG. 4, a ring-shaped recessed groove portion 24 is formed so as to surround an outer periphery of the siphon tube 23, and the gas flow channels 22 penetrated through a bottom surface 24*a* are provided at four positions around the siphon tube 23 at pitches of 90 degrees.

An upper inlet portion of the each gas flow channel 22 described above preferably has an inclined surface which is lowered toward the opening of the gas flow channel 22, for example, like a bowl shape. In other words, the periphery of the upper inlet portion of the each gas flow channel 22 opening at the bottom surface 24*a* is formed with the inclined surface, for example, by chamfering an opening corner of the gas flow channel 22 to allow the liquid entered into the bottom surface 24*a* to be guided easily toward the lower opening position without staying thereon.

The upper inlet portion of the gas flow channel 22 of this type is effective when handling slurry-type chemical solution or the like which is liable to coagulate such as silicon dioxide dispersed solution which is used, for example, in a wafer grinding step in a semiconductor manufacturing process. In other words, in the case where the liquid which is liable to coagulate due to a liquid surface change in transport condition or the like passes through the gas flow channel 22 and enters the bottom surface 24*a*, if the upper inlet portion of the gas flow channel 22 has the inclined surface such as the bowl shape, the liquid flows out rapidly without staying in the interior of the bottom surface 24*a*, thereby preventing the liquid from coagulating and adhering in the interior of the bottom surface 24*a*. Coagulation and adhesion of the chemical solution is not preferable because it might cause change of properties or the like.

The siphon tube 23 is a flow channel for taking the liquid in the container 1 out by pushing by the pressure of the gas, and extends from the plug body 21 to the position in the vicinity of the bottom surface of the container 1. The siphon tube 23 in the drawing has a required length, for example, as shown in FIG. 1 and FIG. 2, secured by connecting an extension tube 23*a* at a portion formed integrally with the plug body 21. In the following description, the entire part including the extension tube 23*a* is referred to as the siphon tube 23 except for a case of necessity.

Provided at an upper end inlet port of the siphon tube 23 is a valve operating portion 25 which presses a valve 54 for discharging liquid provided on the socket 50, described later, to open the same. The valve operating portion 25 is adapted to close part (especially, at an axial center position) of the upper end inlet portion except for penetrated portions 25*a* which serve as liquid flow channels of the siphon tube 23 so as to be pushed upward by being abutted with a lower end portion of the valve 54. The valve operating portion 25 may not be necessary in some cases depending on the type of the socket 50 used in combination with the plug 20.

A lower portion 26 of the plug body 21 of the plug 20 described above, which is press-fitted into the container inlet port 2, is resiliently deformable in a radial direction, and a locking claw 27 projecting toward an inner wall surface 2*a* of the container inlet port 2 is provided on a lower peripheral surface 26*a* of the plug body 21.

The lower portion 26 of the plug body 21 is formed into a thin ring shape, and is provided with slits 28 in the axial direction at adequate positions (for example, four positions at pitches of 90 degrees), so that easy resilient deformation in the radial direction is achieved.

The locking claw 27 enlarged in diameter upward from the side of the lower end portion is formed so as to project from the lower peripheral surface 26*a* of the lower portion 26 described above. The locking claw 27 is set to have a minimum diameter at the lower end portion thereof which is substantially the same with or slightly smaller than the inner diameter of the container inlet port 2, and a maximum diameter of the upper end portion thereof which is adequately larger than the inner diameter of the container inlet port 2. The upper end portion of the locking claw 27 includes a shouldered portion 27*a* reduced in diameter from the maximum diameter.

In other words, the lower portion 26 of the plug body 21 is formed into a thin cylindrical skirt shape divided by the slits 28, and includes the locking claw 27 projecting outward on the side of the lower end portion of the lower peripheral surface 26*a*.

With the structure of the plug 20 as described above, the plug body 21 press-fitted into the container inlet port 2 passes therethrough to a predetermined position by the resilient deformation of the lower portion 26 provided with the locking claw 27 radially inwardly (toward the axial center) by an amount projecting therefrom. In other words, when the lower end portion of the plug body 21 is passed through to a predetermined position with the maximum diameter portion of the locking claw 27 reduced in diameter to the inner diameter of the container inlet port 2 by the resilient deformation thereof, the resiliently deformed lower portion 26 of the plug body 21 is pressed against the inner wall surface 2*a* of the container inlet port 2 by a force of the locking claw 27 in the direction of restoration of its original shape. At this time, if the inner diameter of the container inlet port 2 is enlarged even by a slight amount at a position of the locking claw 27 reached by being press-fitted, the shouldered portion 27*a* of the locking claw 27 is locked by the inner wall surface 2*a*, which prevents disconnection further reliably. The cross-sectional shape of the locking claw 27 is not limited to the illustrated substantially trapezoidal shape and, for example, a substantially triangle cross-sectional shape is also applicable.

Therefore, the plug 20 press-fitted to the container inlet port 2 is fixed in the interior of the container inlet port 2 by the resiliency of the lower portion 26 provided with the locking claw 27.

The plug 20 described above includes a flange portion 29 formed outward from the upper end portion of the plug body 21 and locked to an upper end surface 2*b* of the container inlet port 2. Then, a lower surface 29*a* of the flange portion 29 which comes into tight contact with the upper end surface 2*b* of the container inlet port 2 is formed with a projection 30 over the entire circumference thereof. In other words, the lower surface 29*a* of the flange portion 29, which is formed in the shape of an upper end flange of the plug body 21 is formed with the ring-shaped projection 30 over the entire circumference thereof. The projection 30 functions as a seal portion which prevents the gas from flowing out from between the container 1 and the plug 20 when taking out the liquid. Also, when the container 1 is in transport condition or inverted, it also serves as the seal portion which prevents the gas or the liquid from flowing out from between the container 1 and the plug 20.

Furthermore, the flange portion 29 described above is preferably formed with a ring-shaped projection 31 over the entire circumference on an upper surface 29*b* thereof. The projection 31 functions as the seal portion for preventing the liquid passing through the gas supply channel 22 from flowing out due to swinging of the liquid surface or the like when the container 1 is in transport condition or inverted when mounting the cap 10 in a state in which the plug 20 is press-fitted (see FIG. 1).

Figure 5:
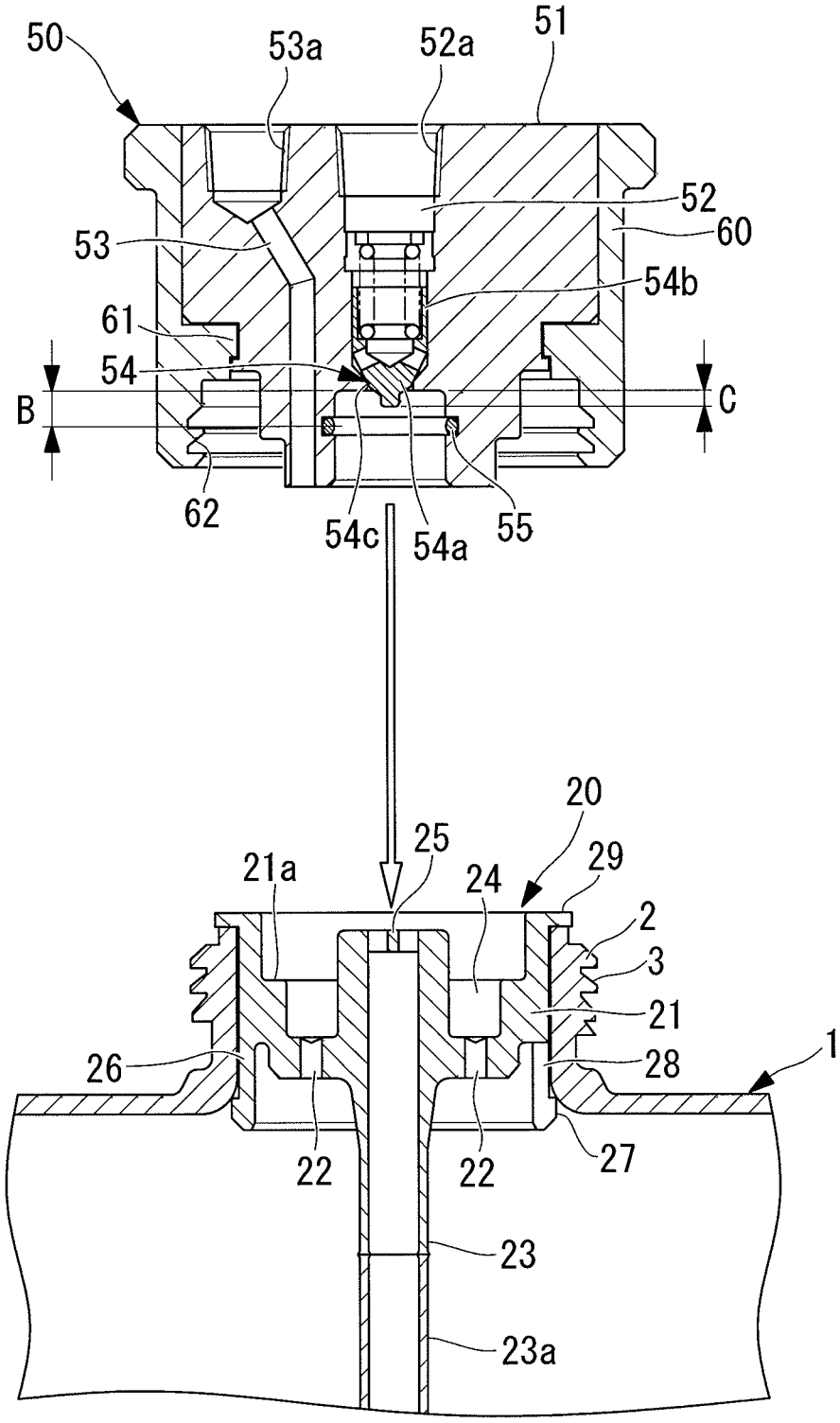
FIG. 5 is a cross-sectional view of the plug structure in FIG. 1 showing a state before attaching the socket instead of the cap.

When taking out the liquid in the interior of the container 1, the plug 20 having the configuration as described above allows the socket 50 to be connected thereto after having removed the cap 10 as shown in FIG. 2 and FIG. 5.

The socket 50 includes a socket body 51, and a sleeve 60 to be fixed to the container 1 in a state in which the socket body 51 is inserted into the plug 20 to a predetermined position. The socket body 51 is a substantially column shaped member formed with a liquid outlet flow channel 52 and a gas flow channel 53.

The sleeve 60 is rotatable on the outer peripheral portion of the socket body 51. Then, the sleeve 60 is provided with an engaging portion 61 having a projection and depression for restraining the movement of the socket body 51 in the axial direction, and is formed with an inner screw 62 which engages with the outer screw 3 of the container inlet port 2 on the side of the lower end portion of the inner peripheral surface. In other words, when attaching the socket 50, the socket body 51 is inserted into the plug 20 to a predetermined position, and the sleeve 60 is rotated to engage the inner screw 62 with the outer screw 3 and tightened, so that the socket body 51 is pulled downward by the engaging portion 61, and is fixed to a state of being in tight contact with the plug 20.

The liquid outlet flow channel 52 is a through hole in the axial direction formed at the axial center position of the socket body 51, and is provided with a connecting port 52*a* of an external conduit for allowing the liquid to be flowed out at the upper end portion thereof. The liquid outlet flow channel 52 communicates with the siphon tube 23 inserted into the interior of the container 1 in a state of being connected with the plug 20 and defines an integral liquid flow channel. The illustrated connecting port 52*a* is formed with an inner screw to engage and connect a plug (not shown) attached to an end of the liquid outlet external conduit.

The gas flow channel 53 is a through hole formed in substantially parallel with the liquid outlet flow channel 52 described above, and serves as a flow channel whose one end is connected to a gas supply source, and other end communicates through the recessed groove portion 24 of the plug 20 to the gas flow channels 22. The gas flow channel 53 is provided with a connecting port 53*a* of the gas supply external conduit at an upper end portion to be connected to the gas supply source. The illustrated connecting port 53*a* is formed with an inner screw to engage and connect a plug (not shown) attached to an end of the gas supply external conduit.

Also, the illustrated socket 50 is of a type having the valve 54 in the liquid outlet flow channel 52. Since a valve element 54*a* is constantly urged downward by a spring 54*b*, the valve element 54*a* is in tight contact with a valve seat 54*c* to close the liquid outlet flow channel 52 in a state before being connected to the plug 20. However, when the socket 50 described above is attached to a predetermined position of the plug 20, the valve operating portion 25 provided on the side of the plug 20 pushes the valve element 54*a* upward against the urging force of the spring 54*b*, and hence the tight contact of the valve element 54*a* with the valve seat 54*c* is released. With the valve 54 opened in this manner, a liquid flow channel for flowing out of the container 1 through the siphon tube 23 and the liquid outlet flow channel 52 is defined.

Incidentally, in the state shown in FIG. 2 in which the socket 50 is attached and fixed to the plug 20, the liquid flow channel in which the siphon tube 23 and the liquid outlet flow channel 52 are in communication is sealed by an O-ring 55. Also, the gas flow channel which is communicated from the gas flow channel 53 to the gas flow channel 22 via the recessed groove portion 24 is sealed by the O-ring 55 described above with respect to the side of the liquid flow channel, and is further sealed with respect to the atmospheric air by a projection 56*a* of a shouldered surface 56 provided on the socket body 51. The sealed state as described above is reliably maintained by the sleeve 60 of the socket 50 engaged with and fixed to the container inlet port 2 of the container 1.

Also, the projection 56*a* described above serves to seal by being pressed by a shouldered surface 21*a* on the side of the plug body 21 which opposes the shouldered surface 56 provided on the socket body 51. Then, in order to ensure the sealing function of the shouldered surface 21*a*, as shown in FIG, 2, a gap 32 as a tightening margin is preferably formed between the upper portion of the projection 31 described above, and the socket body 51 and the sleeve 60 in a state in which the socket 50 is attached to the container inlet port 2, Seal at this portion may be achieved by providing a projection on the shouldered surface 21*a* on the side of the plug body 21.

Also, the plug 20 and the socket 50 described above preferably have a relation; A>B>C, where A is an effective screw length of the inner screw 62 formed on the sleeve 60, B is an attachment distance between the O-ring 55 and an end surface of the plug-receiving opening in the socket, and C a lower end projecting distance between the valve body 54 and the end surface of the plug-receiving opening in the socket 50, as shown in FIG. 2 and FIG. 5.

With the size in this manner, when the sleeve 60 is rotated to remove the socket 50, since the lower end projecting distance C of the valve 54 is set to the smallest dimension, the valve 54 is closed in a state in which the seal of the O-ring 55 is effective. Therefore, the liquid in the interior of the liquid outlet flow channel 52 present at a level above the valve 54 does not flowed out by the removal of the socket 50.

Also, since the attachment distance B of the O-ring 5 is smaller than the effective screw length A of the inner screw 62, the engagement of the sleeve 60 remains in a state in which the seal of the O-ring 55 is effective.

Subsequently, referring now to FIG. 6 to FIG. 8, a plug structure according to the second embodiment of the present invention will be described. The same components as those in the first embodiment described above are designated by the same reference numerals, and detailed description thereof will be omitted.

Figure 6:
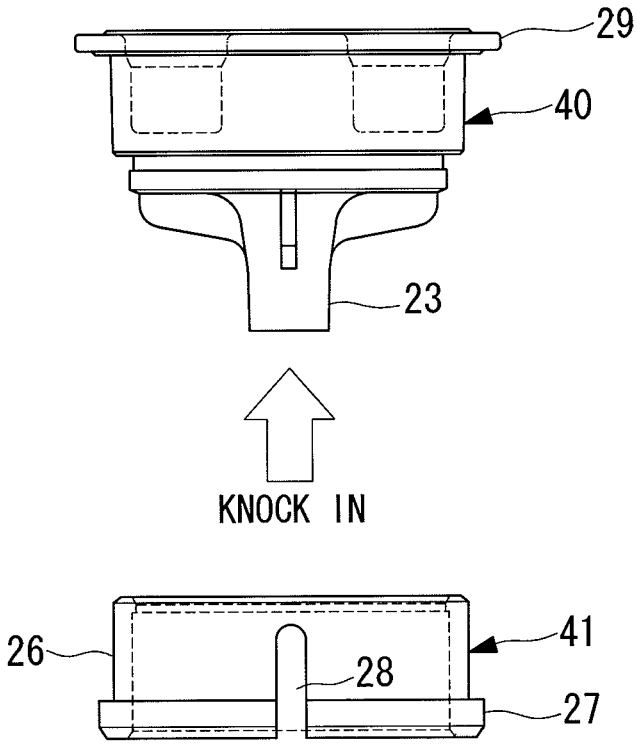
FIG. 6 is an appearance front view showing a second embodiment of a plug structure according to the present invention in a separate state before a lower body is press-fitted into an upper body.
Figure 7:
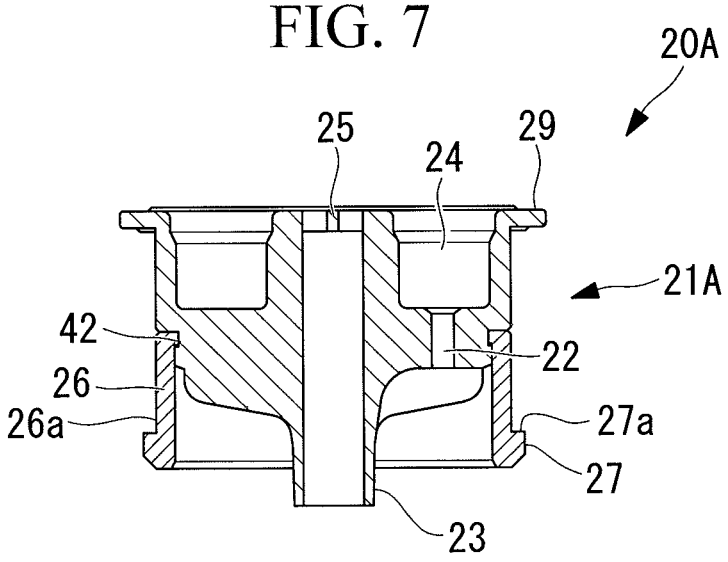
FIG. 7 is an appearance front view showing the plug structure in FIG. 6 in an assembled state.

A plug 20A shown in FIG. 6 and FIG. 7 has a separate structure in which a plug body 21A is divided into two parts. In other words, the plug body 21A is configured in such a manner that a ring-shaped lower body 41 having the locking claw 27 is engaged integrally with an upper body 40 via the press-fitting.

In the case of the plug 20A having such separate structure, the projection such as the locking claw 27 which is difficult to mold by die-cutting due to its integral structure may be molded easily by die-cutting the upper body 40 and the lower body 41 as separate parts. Therefore, in comparison with the plug 20 having the integral structure, the plug 20A having the separate structure is effective in terms of improvement of the productivity and the cost. The upper body 40 and the lower body 41 are maintained in the engaged state reliably by an engaging portion 42 having a projection and a depression when being press-fitted once.

Figure 8:
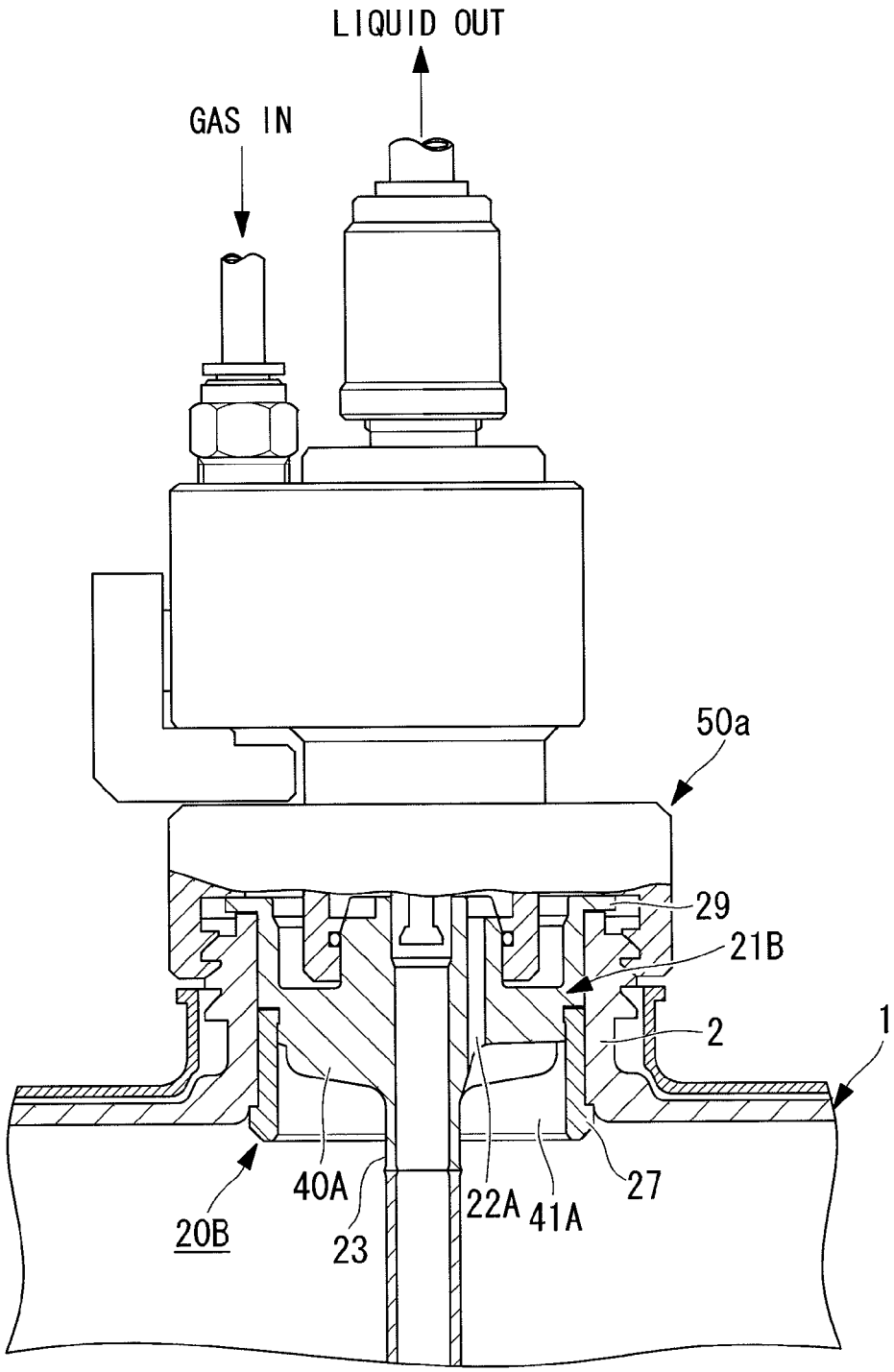
FIG. 8 is a cross-sectional assembling drawing of a principal portion of a modification of the plug structure according to the second embodiment.

A plug 20B of a modification shown in FIG. 8 is different in types of a gas flow channel (a gas supply channel)_22A and a socket 50A used in combination therewith. However, a plug body 21B of the plug 20B is also formed of separate structure including the two parts in this case as well, and the plug body 21BA is a member formed by integrally engaging a ring-shaped lower body 41A having the locking claw 27 with an upper body 40A via the press-fitting.

In the case of the plug 20B having such separate structure as well, the projection such as the locking portion 27 which is difficult to mold by die-cutting due to its integral structure may be molded easily by die-cutting the upper body 40A and the lower body 41A as separate parts.

As described above, according to the plug structure in the present invention, the plug 20 used for the container 1 for filling liquid such as the chemical solution and provided with the siphon tube 23 for delivering the liquid out of the container 1 by the pressure of the gas allows attachment to the container 1 whose cap attachment screw at the container inlet port 2 is the outer screw 3. In addition, by the action of the resilient locking claw 27 provided on the lower portion 26, the plug 20 can be press-fitted and fixed reliably to the container inlet port 2, and the sealing with respect to the container inlet port 2 as well as with respect to the cap 10 is ensured.

Also, by forming the upper inlet portion of the gas flow channel 22 into the inclined surface of the bowl shape, the liquid can easily flow downward into the interior of the container 1, so that accumulation of the liquid and coagulation of the chemical solution are prevented. In this manner, the structure in which the upper inlet portion of the gas flow channel 22 is formed into the bowl shape having the inclined surface is not limited to the plug structure according to the present invention described above and, in particular, the plug shape which handles the easily coagulated liquid may be applied generally to the plug structure being attached to the container inlet port 2 and having the gas flow channel 22 for supplying the gas in the interior of the container 1 and the siphon tube 23 for taking out the liquid in the interior of the container by the pressure of the gas.

Figure 9:
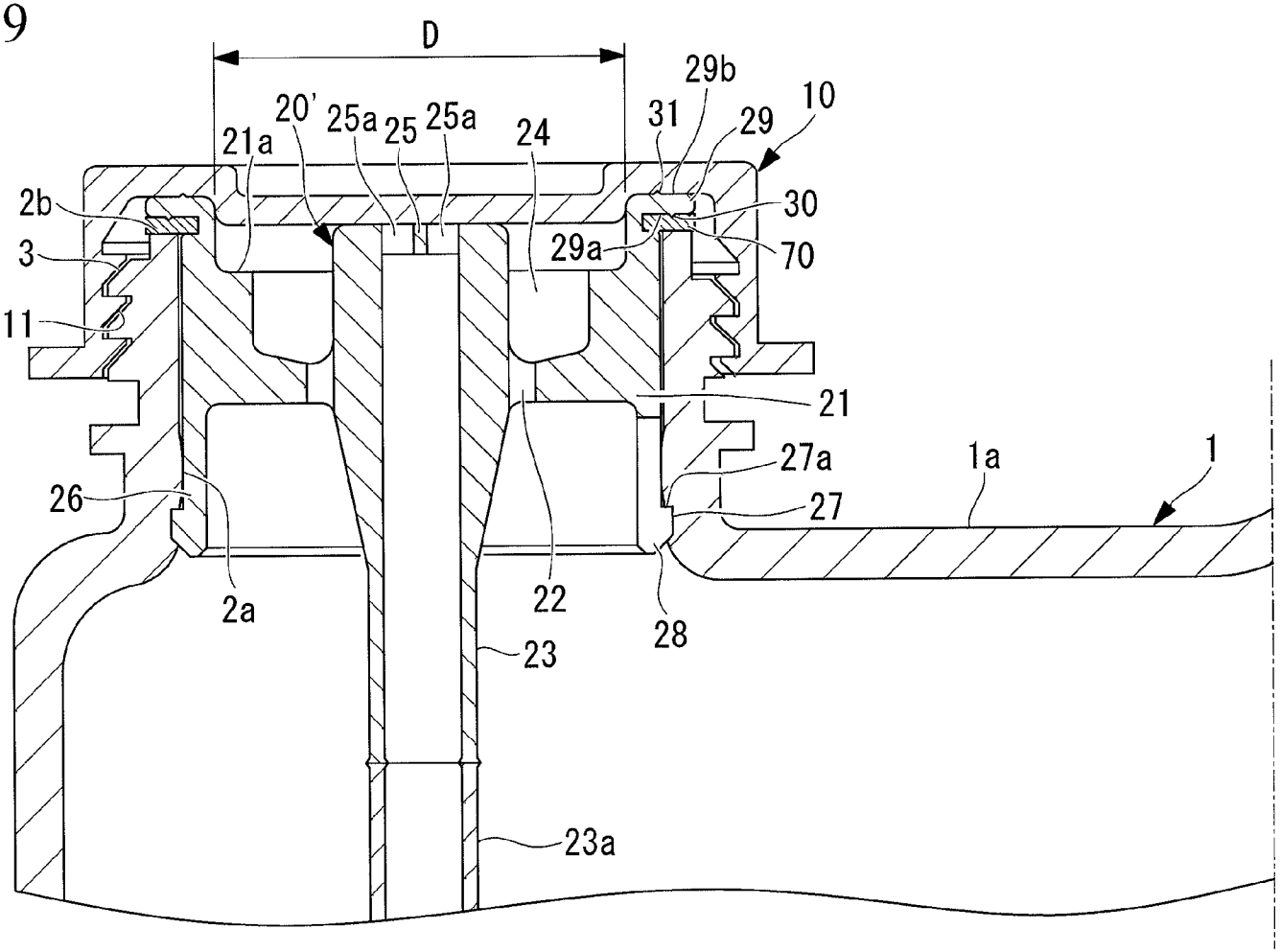
FIG. 9 is a cross-sectional view showing a packing structure as a modification of FIG. 1.
Figure 10:
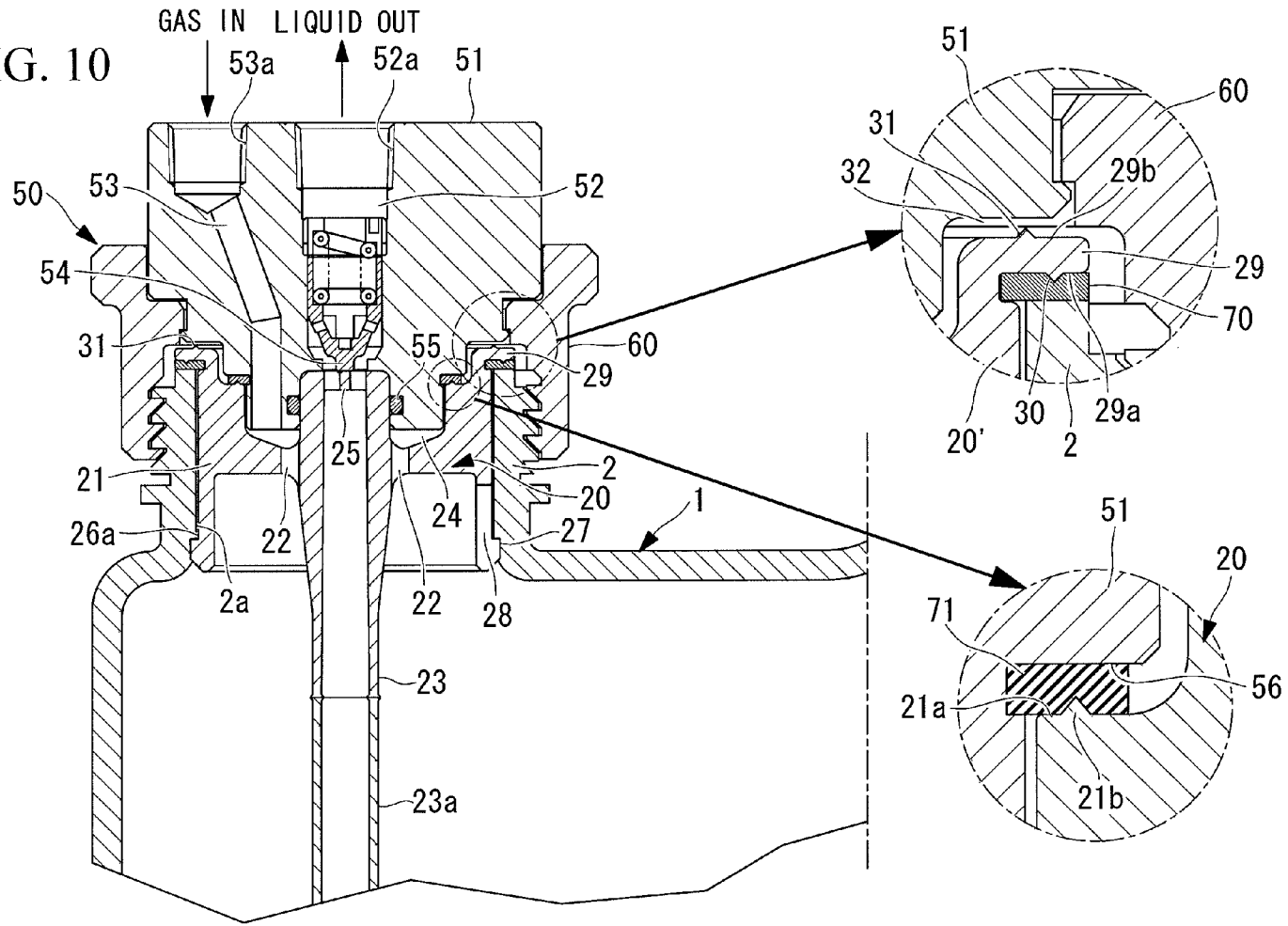
FIG. 10 is a cross-sectional view showing a packing structure as a modification of FIG. 2.

Incidentally, in the two embodiments described above, the sealing function is obtained by providing the flange portion 29 formed outward from the upper end portion of the plug body 21 and locked by the upper end surface 2*b* of the container inlet port 2, and forming the projection 30 which serves as the seal portion on the lower surface 29*a* of the flange portion 29, which comes into tight contact with the upper end surface 2*b* of the container inlet port 2. However, a modification in which the seal portion having a packing structure is applied to a plug 20', for example, as shown in FIG. 9 and FIG. 10 may be employed for obtaining the sealing function as described above. In this modification, since the gas flow channel 22 is arranged in the vicinity of the end portion on the side of the inner periphery of the recessed groove portion 24, the inclined surface which prevents the accumulation of the liquid is formed so as to be lowered in the level from the outer peripheral side to the inner peripheral side toward the opening of the gas flow channel 22.

In other words, the plug body 21 is provided with a packing 70 disposed on the lower surface of the flange portion 29, and the sealing function is obtained by the packing 70 being compressed between the upper end surface 2*b* of the container inlet port 2 and the flange portion 29 of the plug body 21. Preferably, an attachment recess is provided for preventing the packing 70 from falling off on the side of the plug body 21.

With the packing structure as described above, the packing 70 functions not only as the seal portion for preventing the gas flowing out from between the container 1 and the plug 20 when taking out the liquid, but also as the seal portion for preventing the gas and the liquid from flowing out from between the container 1 and the plug 20 when the container 1 is in transport condition or inverted. In the case where the packing structure is employed, if the projection 30 of the flange portion 29 described above is present, it digs into the packing 70, so that the sealing function is further improved.

The same packing structure may also be employed as a modification of the seal portion formed between the shouldered surfaces 21*a*, 56.

In this modification, as shown in FIG. 10 for example, a seal portion having the packing structure in which a packing 71 is disposed over the entire circumference is formed between the shouldered surface 21*a* of the plug body 21 and the shouldered surface 56 of the socket body 51. In the illustrated seal portion, a projection 21*b* is provided on the shouldered surface 21*a* and is caused to dig into the packing 71. However, a configuration in which the projection is provided either one of, or both of the shouldered surfaces 21*a*, 56 may be employed. Then, in this modification as well, the gap 32 which functions as the tightening margin is formed between the upper portion of the projection 31 and the socket body 51 and the sleeve 60 as described above in order to ensure the sealing function between the shouldered surfaces 21*a*, 56 in the state shown in FIG. 10 in which the socket 50 is attached to the container inlet port 2.

The position of installation of the packing 71 described above is not limited to a position between the shouldered surfaces 21*a*, 56 and, for example, may be provided over the entire circumference of the upper surface 29*b*.

Although the dimension of an inner diameter D of the plug 20' depends on the type of the container 1, it is set to allow the utilization of the sealing structure of the cap 10 which is provided originally on the side of the container 1.

In the embodiment described above, when taking out the liquid from the interior of the container 1, it is achieved by supplying the gas pressure into the interior of the container 1 to cause the pressure onto the liquid surface and pushing out the liquid by this pressure. However, it is also possible to push out the liquid with a pump by connecting a pipe to the liquid outlet flow channel 52 of the socket 50. In this case, the gas flow channel 53 serves as a flow channel for supplying the atmospheric air or the like into the container 1 by an amount of reduction of the liquid for replacement.

The present invention is not limited to the embodiments described above, and may be modified as needed without departing the scope of the present invention.

The invention claimed is:

1. A plug structure used for a container whose cap attachment screw of a container inlet port is an outer screw, configured to be attached to the container inlet port, and provided with a siphon tube for taking out liquid in the interior of the container, comprising:

a plug body to be press-fitted into the container inlet port being resiliently deformable in a radial direction at a lower portion thereof;

a locking claw provided on an outer peripheral surface of the lower portion of the plug body, extending outwardly from the outer peripheral surface in direct engagement with an inner wall surface of the container inlet port; and a socket including a socket body, a sleeve, and an O-ring;

wherein the sleeve is attached to the container by engaging its inner screw with the outer screw of the container in a state in which the socket body is inserted into the plug body to a predetermined position;

wherein the O-ring seals a liquid flow channel in which the siphon tube and the liquid outlet flow channel penetrating through the socket body in an axial direction thereof are in communication with each other;

wherein the plug body is fixed in the interior of the container inlet port by the resiliency of the lower portion provided with the locking claw;

wherein a valve operating portion which presses a valve body of a valve for discharging liquid provided on the socket to open is provided at an upper end inlet port of the siphon tube; and wherein A>B>C is satisfied:

where

A is an effective screw length of the inner screw formed on the sleeve;

B is an attachment distance between the O-ring and an end surface of the plug-receiving opening in the socket; and C is a lower end projecting distance between the valve body and the end surface of the plug-receiving opening in the socket; and wherein the upper end inlet port of the siphon tube engages the end surface of the plug-receiving opening in the socket.

2. The plug structure according to claim 1, further comprising:

a flange portion formed to extend outward from an upper end portion of the plug body and locked by an upper end surface of the container inlet port, the flange portion being formed with a seal portion extending over an entire circumference on a lower surface which comes into tight contact with the upper end surface of the container inlet port.

3. The plug structure according to claim 2, wherein the flange portion includes the seal portion formed over the entire circumference of an upper surface.

4. The plug structure according to claim 2, wherein the plug body is configured in such a manner that a ring-shaped lower portion having the locking claw is press-fitted into an upper body and engaged integrally therewith.

5. The plug structure of claim 1, further comprising:

a gas supply channel attached to the container inlet port for supplying gas into the interior of the container; and a siphon tube for taking out liquid in the interior of the container, wherein an upper inlet portion of the gas supply channel is formed with an inclined surface which is lowered toward an opening.

6. The plug structure of claim 2, further comprising:

a gas supply channel attached to the container inlet port for supplying gas into the interior of the container; and a siphon tube for taking out liquid in the interior of the container, wherein an upper inlet portion of the gas supply channel is formed with an inclined surface which is lowered toward an opening.

* * * * *